United States Patent [19]

Paxton

[11] 4,361,935

[45] Dec. 7, 1982

[54] BAG CLOSURE

[76] Inventor: Jerre H. Paxton, P.O. Box 9548, Yakima, Wash. 98909

[21] Appl. No.: 157,450

[22] Filed: Jun. 9, 1980

[51] Int. Cl.[3] ..... B65D 77/10; A44B 21/00

[52] U.S. Cl. ..... 24/30.5 R; 24/30.5 S; 24/255 R; 24/DIG. 28; 206/343; 206/820

[58] Field of Search ..... 24/30.5 S, 30.5 R, 30.5 P, 24/30.5 L, 255 R, 255 BS, 255 SL, DIG. 28; 248/314; 206/343, 820

[56] References Cited

U.S. PATENT DOCUMENTS

| | | | |
|---|---|---|---|
| 255,922 | 4/1882 | Bradford | 24/30.5 R |
| 1,780,880 | 11/1930 | Johnson | 24/30.5 R |
| 3,164,249 | 1/1965 | Paxton | 24/30.5 S |
| 3,164,250 | 1/1965 | Paxton | 24/30.5 S |
| 3,170,213 | 2/1965 | Thomas, Jr. | 24/255 |
| 3,348,595 | 10/1967 | Stevens, Jr. | 150/3 |
| 3,621,632 | 11/1971 | Browning . | |
| 3,822,441 | 7/1974 | Paxton | 24/30.5 S |
| 3,906,592 | 9/1975 | Sakasegawa et al. | 24/255 SL |
| 4,026,413 | 5/1977 | Britt et al. | 206/343 |
| 4,189,808 | 2/1980 | Brown | 24/30.5 R |

FOREIGN PATENT DOCUMENTS

| | | | |
|---|---|---|---|
| 1326485 | 4/1963 | France | 24/30.5 R |
| 883771 | 12/1961 | United Kingdom | 24/30.5 S |
| 999929 | 7/1965 | United Kingdom | 24/30.5 R |
| 1409426 | 10/1973 | United Kingdom . | |
| 1403286 | 8/1975 | United Kingdom | 206/820 |

*Primary Examiner*—Victor N. Sakran

*Attorney, Agent, or Firm*—Seed, Berry, Vernon & Baynham

[57] ABSTRACT

Several unique bag closure features are presented, with one embodiment having a bag-neck confining opening provided with inwardly depending appendages peripherally spaced from one another and with blunted ends to protect the bag, but with sharp corners to hold the bag. Another feature of the invention is a perforated plastic bag closure, with the perforations being arranged in a unique pattern to maximize the strength of the closure while reducing its weight. A third feature is a plurality of interconnected, flat, generally rigid closures which are joined in an elongated strip by sets of transversely spaced but outwardly, generally convex webs which space the adjoined, adjacent closures from one another yet leave a smooth web when the closures are separated by breaking the webs.

8 Claims, 6 Drawing Figures

FIG. 1A
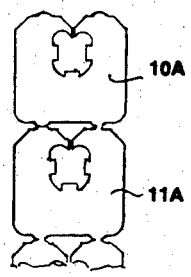
FIG. 1B
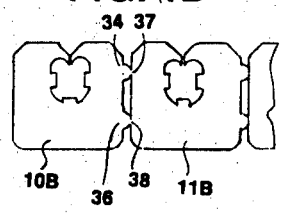
FIG. 1C
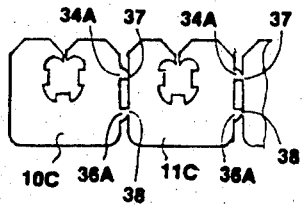
FIG. 4
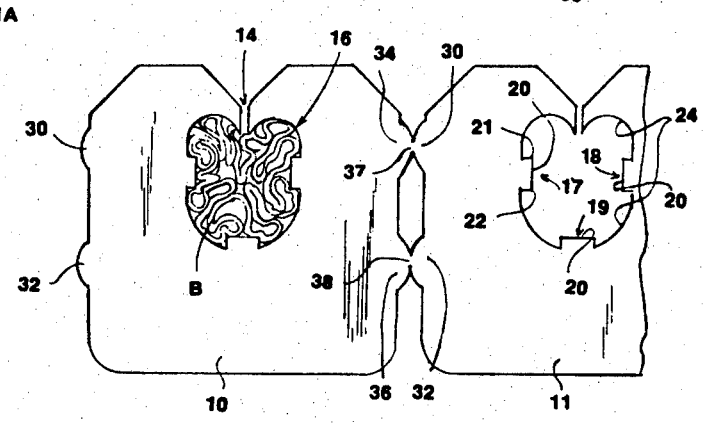
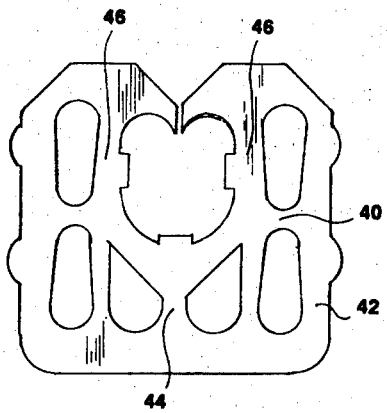
FIG. 3
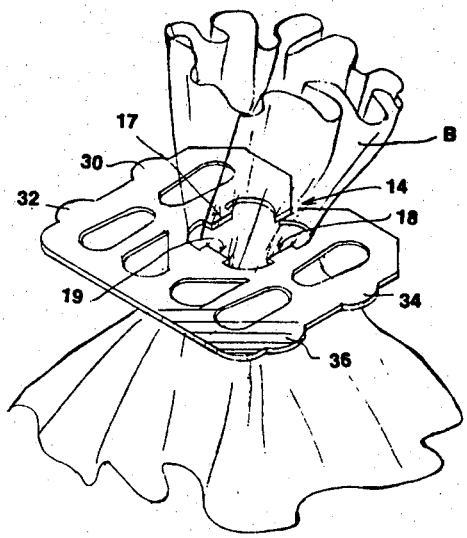
FIG. 2

BAG CLOSURE

BACKGROUND OF THE INVENTION

1. Field of the Invention

This invention pertains to closures formed of flat material for holding closed the necks of flexible bags and to strips of such closures which can be separated by breaking the connections between adjacent closures on the strip.

2. Description of the Prior Art

The first invention of this application pertains to a flat, generally rigid bag closure of the type having a side edge, bag-neck access opening which joins an enlarged central bag-neck confining aperture. This type of closure is well known, with typical examples being shown in U.S. Pat. Nos. 3,164,250 and 3,822,441, and British Pat. No. 1,409,426. These closures have all included a bag-neck confining aperture, with the shape of the aperture differing from a generally smooth peripheral edge, as in U.S. Pat. No. 3,164,250, to a plurality of sharpened points, as in U.S. Pat. No. 3,822,441, or, as in British Pat. No. 1,409,426, a pair of blunted, inward protrusions. In one other known closure of this type, protrusions of the type shown in the British specification terminate in sharp points for better gripping the bag neck.

The purpose of sharpened points on the protrusions or appendages extending into the bag-neck confining aperture is to grip the neck of the bag to keep it from moving lengthwise of the bag out of the closure and to keep the bag from moving laterally back out through the bag-neck access opening. The location and shape of the protrusions within the bag-neck confining opening, however, are critical. Whereas the smooth type of aperture, such as in U.S. Pat. No. 3,164,250, will hold many bags, it tends to slide on some types of plastic bag materials. On the other hand, the sharp-pointed protrusions in the bag-neck confining opening of the closure in U.S. Pat. No. 3,822,441, while ideally suited for open-mesh net bags, will perforate or tear some types of plastic bag materials. The protrusions in British Pat. No. 1,409,426, and with sharpened ends on the protrusion of the type shown in the British specification, have tended to follow the worst features of both having not a sufficient number of sharpened points for good holding of most plastic bag materials, but where sharpened, having the location of the points in poor locations for good bag holding but tending to cause bag perforation or tearing.

It is thus an object of this invention to provide a flat closure of the type having a side edge bag-access opening to a bag-neck confining aperture in which a plurality of spaced, inwardly extending appendages are provided to better hold plastic-film bag materials without damaging the bag material.

It is another object of this invention to provide a flat closure of the type having a side edge access opening to a bag-neck confining aperture in which there are a plurality of peripherally spaced appendages which separately hold multiple folds of the bag neck material for greater resistance to sliding on the bag neck.

Basically, these objects are achieved by providing a flat, generally rigid closure having a side edge, bag-neck access opening which joins a bag-neck confining aperture, the bag-neck confining aperture having a periphery defined by a plurality of peripherally spaced, inwardly extending appendages, each having a blunted inner edge and at least one bag-gripping sharp corner and wherein the spaces between and around said appendages receive the neck of the bag, with the sharp corners holding the flexible bag against endwise and sidewise movement through the closure. In the preferred embodiment, sharpened jaws define the access opening and three spaced, additional appendages are provided, with the blunted inner edges of the appendages facing towards the center of the aperture and each terminating in opposite pairs of sharpened corners which generally face the corners of adjacent appendages and jaws of the access opening. The multiple sharpened corners hold the flexible, slippery plastic material well regardless of the type of material and amount of material being fed into the bag-neck confining aperture. The blunted edges, however, press more gently against the bag material to reduce penetration or tearing of the bag material by the sharpened corners. In the preferred embodiment, the appendages and jaws of the access opening provide eight different points of bag gripping while allowing the bag to wrap itself into the spaces around and between the points for better gripping of the bag neck material. It is particularly advantageous to have one of the appendages directly aligned with the bag-access side opening and with its blunted edge facing the opening so that bag neck material being fed in through the bag-access opening will not snag on the appendage, allowing the material to be fed completely into the aperture and reducing the chance of tearing the bag material as it is fed or pushed in through the access opening.

A second invention of this application is a web-attachment technique for adjacent closures in a multi-closure strip of closures, each of the type having a side edge, bag-neck access opening joining a bag-neck confining aperture. Multi-strip closures of this type are shown, for example, in U.S. Pat. No. 3,164,250, which are joined side-by-side, or in U.S. Pat. No. 3,164,249, which are joined end-for-end, and these closures have webs or strips of attachment between adjacent closures in the strip which are spaced transversely of the length of the strip and are of a sufficient thickness lengthwise of the strip to space the adjacent closures along the strip. When the closure is placed on a bag neck, the webs at spaced fracture points are broken to separate the closure from the strip. In some cases, the fracture point does not sever cleanly at the edge of the closure, leaving a jagged protruding tab. These jagged tabs can be an annoyance as they give a rough feel to the otherwise smooth edge of the closure or can snag the plastic bag material of other bags when packed together. Various attempts by others have been made to reduce the formation of rough tabs, an example being shown in British Pat. No. 1,409,426, mentioned above. These other attempts have generally been unsatisfactory.

It is an object of this invention, therefore, to provide attachments between closures in a multi-closure strip which are shielded when the fracture points are broken during the removal of a strip so that the fracture points do not protrude from the edge of the separated closure as thin jagged tabs.

It is another object of this invention to provide transversely spaced points of attachment between adjacent closures in a multi-closure strip which are each provided with a blunted shielding surface adjacent the point of attachment with the next adjacent closure.

Basically, these objects are obtained by providing a multi-closure strip of the type in which each closure has a side bag-neck access opening which joins a bag-neck confining aperture with transversely spaced webs or points of fracture between the adjacent closures in the strip and which separate the closures lengthwise along the strip. The webs are provided with enlarged bases which terminate at the point of fracture so that upon removal of a closure from the strip, the enlarged base shields the point of fracture, reducing the chance of snagging on bag material or of leaving a jagged feel to the edge of the closure. In the preferred embodiment of the invention, each closure is provided with webs on each side or edge of the closure lengthwise of the strip, with each web having an enlarged base. Preferably, the enlarged bases are generally convex in relation to the length of the strip. In alternative embodiments, however, the closures can be provided with webs only on one edge lengthwise of the strip, with the point of fracture being flush with the adjacent joined edge of the next adjacent closure. Also, in alternative embodiments, the enlarged base can have its most lateral edge of each web rounded or blunted to shield the point of fracture, but its inner edge can be left generally straight, with some loss of protection to the point of attachment. As it is well understood, the closures can be joined end-for-end or side-by-side, as shown in U.S. Pat. Nos. 3,164,250 and 3,164,249, with the principles of this invention applying to either arrangement.

The third invention of this application is a light-weight plastic bag closure of the type having a flat body with a bag-neck side access opening which joins with a bag-neck confining aperture within the body, the improvement providing a plurality of closed openings surrounded by a pattern of solid webs. The closed openings are provided to reduce the amount of plastic used in the manufacture of the closure, with the pattern of solid webs provided to maintain a high degree of strength in areas in which twisting or severe stress loading occurs on the closure. Prices of raw plastic material for the manufacture of closures has more than tripled in the past few years, making it desirable to reduce the amount of plastic used in the manufacture of a closure. By providing the closure with a series of closed openings arranged in a pattern which leaves solid webs at the high stress areas, the removed plastic can be recycled, greatly reducing the cost of the closures without weakening the closures.

These objects and advantages are obtained in this invention by providing the plastic bag closure of the type having a flat, generally rigid body and a side bag-neck access opening communicating with a bag-neck confining aperture, with a plurality of closed openings surrounding the aperture and separated by a pair of first solid webs which lie generally perpendicular to a line through the side bag-neck access opening and adjacent opposite sides of said bag-neck confining aperture, and a peripheral solid web around the closed openings starting at one side of the bag-access opening and continuing around between the periphery of the closure outside of the closed openings to the other side of the bag-access opening. In the preferred embodiment, additional closed openings and webs are provided, with a second solid web positioned in alignment with the bag-access opening between the peripheral web and the aperture and with third solid webs located along generally parallel lines on opposite sides of the aperture and generally parallel to a line through the bag-neck access opening.

BRIEF DESCRIPTION OF THE FIGURES OF THE DRAWING

FIG. 1A is an end-for-end attached multi-closure strip employing principles of the inventions.

FIG. 1B is a side-by-side strip of multiple closures showing another embodiment.

FIG. 1C shows still a third embodiment of a multi-closure strip.

FIG. 2 is an enlarged isometric of a closure embodying some of the principles of these inventions shown on the neck of a plastic bag.

FIG. 3 is an enlarged view of the closure shown in FIG. 2.

FIG. 4 is an enlarged view of a multi-closure strip of solid closures of the type shown in FIGS. 1, with fracture points for a multi-closure strip as shown in FIG. 1A and with a bag neck confined within the bag-neck confining aperture of the closure.

DETAILED DESCRIPTION OF THE PREFERRED EMBODIMENTS

Of the several inventions disclosed in this application, the description will be directed first to the bag-neck confining opening, then to the technique for attaching multi-closures in a strip form, and finally, to the light-weight closure. It should be understood, however, that each of the these inventions is usable in combination with the other inventions, with the drawings being provided to represent various embodiments, all, however, usable along or in the combination illustrated. As best shown in FIG. 4, the closures 10 and 11 form part of a multi-closure strip of the type shown in U.S. Pat. No. 3,164,250, in side-by-side arrangement. Similarly, FIG. 1A shows a multi-closure strip with the closures 10A and 11A being in an end-for-end arrangement, such as shown in U.S. Pat. No. 3,164,249. The closure in all embodiments is made of a flat springy plastic, generally rigid, such as a 0.0032 inch gauge polystyrene, with a side-edge, bag-neck access opening 14 which is joined with a bag-neck confining aperture 16.

The bag-neck confining aperture 16 in the invention of this application is provided with appendages 17, 18, and 19, each of which has a blunt forward edge 20 and opposite corners 21 and 22. These appendages are peripherally spaced from one another, preferably equidistantly, to define bag-receiving recesses 24, the endmost recesses remote from the access opening 14 having confronting pointed corners more closely spaced in a straight line than the distance between said corners along the periphery of the recess. Preferably, appendage 19 is aligned with the bag-neck access opening so that as the bag is pushed into the aperture 16, it will hit the blunt surface 20 of appendage 19 and be free to slide laterally and accumulate in folds in each of the recesses 24. With the corners opposed to one another and surrounding the recesses 24, it can be seen that good bag gripping is provided regardless of whether a little amount of bag material is fed into the aperture or a lot of material is fed into the aperture. An example is shown in closure 10 of FIG. 4, with the bag material identified by reference character B. The blunt edges 20 of each of the appendages also provide a smooth non-snagging surface to spread the bag material toward the sharp corners, with the corners protruding only a slight amount, so that there is little chance for perforation or tearing of the bag material.

The second invention is shown in FIGS. 1A–1C and FIG. 4. FIG. 4 best illustrates the most advantageous embodiment of this invention and includes a set of transversely spaced webs 30 and 32 on one side edge of the closure and a second set of webs 34 and 36 transversely spaced relative to the strip on the opposite edge of the closure. These webs are joined at very narrow points of fracture 37 and 38. The webs have substantial thickness in the length direction of the strip and are spaced from one another transversely of the length direction of the strip. The thickness provides adequate spacing between adjacent closures for manipulating the closures and the transverse spacing gives good stability to the closures in strip form for handling and for controlled separation. The webs have enlarged bases surrounding the points of attachment 37 and 38 so that when separated from the strip, as in FIGS. 2 or 3, the base provides a generally rounded, shielding surface to the points of fracture.

FIG. 1A shows a similar web arrangement, but with the closures arranged end-for-end on the strip. FIG. 1B shows a strip of multi-closures with the webs 34 and 36 being formed only on one of the side edges of the closure, with the points of fracture 37 and 38 lying generally in the plane of the edge of the next closure in the strip.

FIG. 1C shows a side-by-side multi-closure strip with the enlarged bases of the webs 34*a* and 36*a* being half circular in shape, such that the laterally outer edges of the enlarged bases of the closures are smoothly curved on each of the webs 34*a* and 36*a*, but with the inner edges straight. This is a less desirable form of closure attachment but would be suitable because the base outer curved edges would, in most instances, provide the desired feel of smooth surfaces, even though the inner edges remained sharp.

Each of the embodiments shown in FIGS. 1B and 1C could, of course, be provided with webs on opposite edges, such as shown in FIG. 4, without departing from the principles therein.

While the various inventions and the embodiments of the various inventions have been illustrated and described, it should be understood that variations will be apparent to those of ordinary skill in the art without departing from the principles herein. Accordingly, the invention is not to be limited to the specific embodiments illustrated in the drawing.

I claim:

1. A side opening closure for closing the neck of a flexible bag or the like, comprising:

a body of flat, generally rigid material having a bag-neck confining aperture and a bag-access opening to said aperture through a side edge of the body, said access opening dividing the body on opposite sides thereof into a pair of jaws;

said bag-neck confining aperture having a peripheral outline defined by a plurality of peripherally spaced, inwardly extending appendages each having a generally straight, blunted inner edge and a generally straight, blunted side edge defining at least one bag-gripping, pointed corner, and wherein the spaces between and around said appendages define recesses to receive the neck of the bag with the pointed corners of adjacent appendages confronting one another for holding the flexible bag against rotational, endwise movement through the closure.

2. The closure of claim 1, said blunted inner edge of each appendage facing generally centrally inward of said bag-neck confining aperture.

3. The closure of claim 1, said appendages-including a first appendage aligned with and facing said access opening, and second and third appendages aligned at right angles to said first appendage and opposite one another, each said appendage having a blunted inner edge facing centrally inward of said bag-neck confining aperture and said first appendage having its inner edge terminating in a pair of pointed corners, with the pointed corners of peripherally adjacent appendages being opposed to one another.

4. The closure of claim 1, wherein at least one appendage is opposite the bag-access opening, with a blunted edge facing the access opening to protect the bag against tearing and binding as the bag is pushed into said aperture.

5. The closure of claim 1, said appendages including an end appendage facing said bag-access opening and opposed side appendages, the appendages each having said blunt inner edge, the blunt inner edges of the first and second side appendages each having at least one adjoining pointed corner, the blunt inner edge of said end appendage having opposite pointed corners opposed to the pointed corners of the edges of said side appendages for providing at least four bag-gripping corners and said two bag-gripping jaws for holding said bag neck.

6. A side opening closure for closing the neck of a flexible bag or the like, comprising:

an integral body of flat, generally rigid material having a bag-neck confining aperture and a bag-access opening to said aperture through a side edge of the body, said bag-neck confining aperture having a periphery which includes at least one bag-neck locking channel defined by adjacent confronting pointed corners each bounded by and adjoining generally straight blunt edges on either side of the corner, and wherein the distance between the corners along a straight line is shorter than the distance between the corners along the periphery of the bag-neck confining aperture, whereby the bag neck can be gathered within the locking channel and held by the pointed corners but is prevented from perforating by the adjoining blunt edges.

7. The closure of claim 6, including at least two said bag-neck locking channels each symmetrically located on either side of a line extending through said bag-access opening and bisecting said aperture, said channels being located in said aperture along the periphery of the aperture remote from said bag-access opening.

8. The closure of claim 7, said bag-access opening including a pair of spaced edges terminating in points facing into said aperture.

* * * * *